United States Patent [19]

Levinson

[11] 4,349,496

[45] Sep. 14, 1982

[54] METHOD FOR FABRICATING FREE-STANDING THICK-FILM VARISTORS

[75] Inventor: Lionel M. Levinson, Schenectady, N.Y.

[73] Assignee: General Electric Company, Schenectady, N.Y.

[21] Appl. No.: 247,964

[22] Filed: Mar. 26, 1981

[51] Int. Cl.[3] ..... H01C 7/10

[52] U.S. Cl. ..... 264/61; 427/101; 427/102; 338/21

[58] Field of Search ..... 338/21; 264/61; 427/101, 102, 126.3, 126.6

[56] References Cited

U.S. PATENT DOCUMENTS 4,103,274 7/1978 Burgess et al. ..... 338/21

4,186,367 1/1980 Chakrabarty et al. ..... 427/126.3

FOREIGN PATENT DOCUMENTS 55-82404 6/1980 Japan ..... 338/21

*Primary Examiner*—John D. Smith

*Attorney, Agent, or Firm*—Alexander M. Gerasimow; James C. Davis, Jr.; Marvin Snyder

[57] ABSTRACT

A free-standing, thick-film varistor is fabricated by screen printing on a smooth aluminum oxide substrate an unfired standard varistor powder mixed with a suitable organic carrier and heating the printed varistor at high temperature (1000° C.–1400° C.). The fabricated varistor adheres lightly to the insulating substrate and may be easily separated therefrom. The insulating substrate may be reused.

16 Claims, 1 Drawing Figure

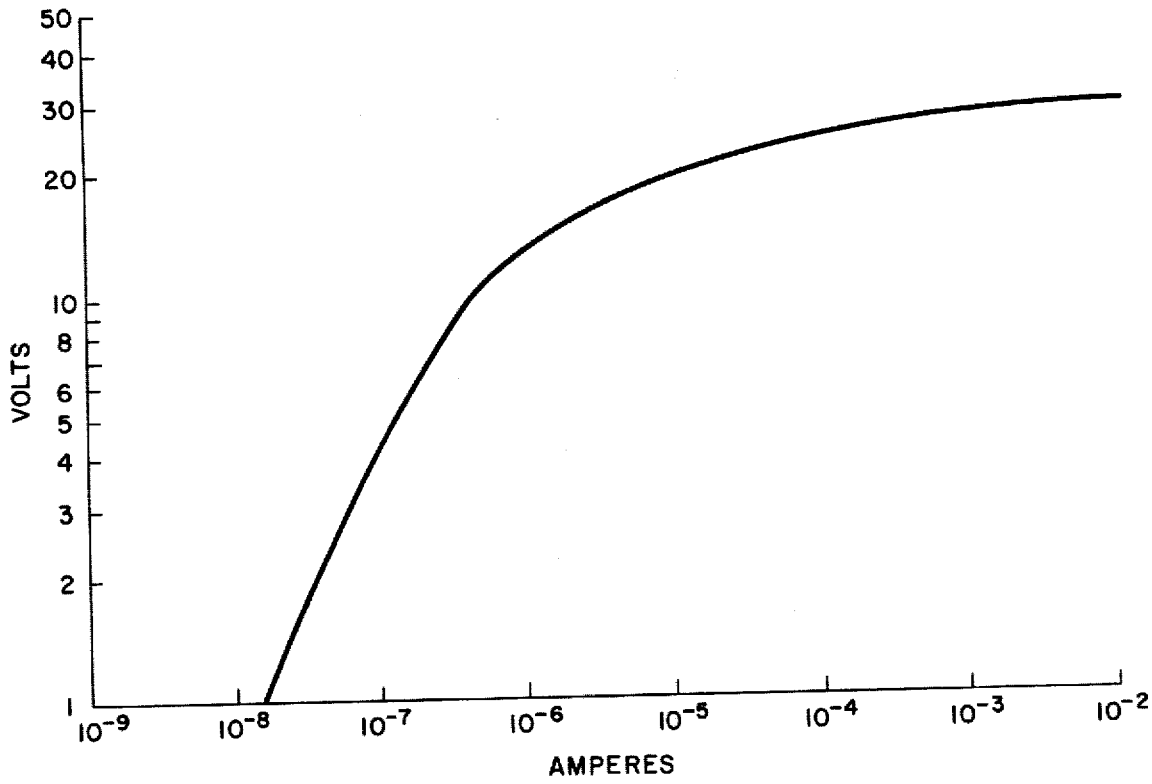
50
40
30
20
10
8
6
5
4
3
2
1
VOLTS
$10^{-9}$
$10^{-8}$
$10^{-7}$
$10^{-6}$
$10^{-5}$
$10^{-4}$
$10^{-3}$
$10^{-2}$
AMPERES

METHOD FOR FABRICATING FREE-STANDING THICK-FILM VARISTORS

BACKGROUND OF THE INVENTION

The present invention relates to low voltage metal oxide varistors, and in particular to free-standing, thick-film varistors fabricated by screen printing.

In general, a metal oxide varistor comprises a zinc oxide (ZnO) based ceramic semiconductor device with a highly nonlinear current-voltage relationship which may be represented by the equation $I=(V/C)^{\alpha}$, where V is the voltage between two points separated by the varistor material, I is the current flowing between the points, C is a constant, and $\alpha$ is a measure of device nonlinearity and is a number greater than 1. If $\alpha=1$, the device exhibits ohmic properties. For values of $\alpha$ greater than 1 (typically 20–50 or more for ZnO based varistors), the voltage-current characteristics are similar to those exhibited by back-to-back connected Zener diodes but with much greater voltage, current, and energy-handling capabilities. Thus, if the voltage applied to the varistor is less than the varistor breakdown voltage, only a small leakage current will flow between the electrodes and the device is essentially an insulator having a resistance of many megohms. However, if the applied voltage is greater than the varistor breakdown voltage, the varistor resistance drops to an extremely low value (tenths of an ohm) permitting large currents to flow through the varistor. Under varistor breakdown conditions, the current through the varistor varies greatly for small changes in applied voltage so that the voltage across the varistor is effectively limited to a narrow range of values. The voltage limiting or clamping action is enhanced at higher values of $\alpha$.

Metal oxide varistors have been widely employed for protecting electrical equipment from voltage transients on AC power lines created by switching of electrical apparatus or lightning storms. Such applications require the use of varistors having breakdown voltages slightly greater than the maximum input voltage of the system to be protected. Thus, for example, a typical system powered from 120 volt AC power mains would require the use of a varistor having a breakdown voltage somewhat greater than 120 volts.

In some applications, however, varistors with much lower breakdown voltages are required. An exemplary application of varistors having breakdown voltages of 50 volts or less is in multiplexing of display cells in large area liquid crystal displays of the type described in U.S. Pat. No. 4,233,603 issued on Nov. 11, 1980 to D. E. Castleberry and which is assigned to the same assignee as the present invention.

One way to fabricate low voltage varistors is to mechanically reduce the thickness of the varistor material by grinding or abraiding, for example. This method is not satisfactory for commercial production since the varistor breakdown voltage may be approximately 6 volts/0.001 inch depending on the formulation of the varistor material. Thus, to produce a varistor having a breakdown voltage of 50 volts, it is necessary to grind or otherwise reduce the thickness of the varistor material to approximately 8 thousandths of an inch. Not only is it difficult to produce varistors of such dimensions by mechanical means, but it is also uneconomical to do so. Moreover, this method does not consistently produce varistors having the desired electrical characteristics. Similarly, conventional methods of fabricating varistors are not readily adaptable to produce thin varistors. Typically such methods require cold pressing the varistor powder prior to firing it. It is difficult to press varistor powder to a thickness of 8–10 thousandths of an inch.

Another approach to fabricating thin varistors, known as thick-film varistors, is exemplified by U.S. Pat. No. 3,725,836 issued to Wada et al. In accordance with this method, the varistor is manufactured by screen printing on an insulating substrate a composite made up of pulverized sintered varistor material, a glass binder and a suitable carrier. The printed composite is sintered at a relatively low temperature of between 600° C.–1000° C. During sintering, the binder evaporates and the glass melts, binding the varistor material particles together and to the insulating substrate. Because the insulating substrate is thus firmly bonded to the varistor, electrodes must be affixed adjacent to each other on the free side of the varistor material. Not as conveniently, the electrodes may be affixed to opposite sides of the varistor, if one of the electrodes is bonded to the insulating substrate prior to screen printing and firing of the varistor composite. In this configuration, one of the electrodes is disposed between the insulating substrate and the body of the varistor. Varistors produced in accordance with the afore-described method are known as "reconstituted" varistors.

The production of screen-printed, reconstituted varistors is not commercially economical since it is first necessary to fabricate a varistor material which must be crushed and pulverized prior to its use in screen printing. The process of "reconstituting" the varistor also requires an additional sintering step. If electrodes are to be affixed to the varistor simultaneously with the sintering of the printed varistor, the electrodes must be of a noble metal alloy, such as platinum-palladium-gold, to withstand the corrosive effects of high temperature bismuth which is typically included in convetional varistor compositions.

One disadvantage associated with screen printed reconstituted varistors is that the varistor material bonds tenaciously to the insulating substrate, leaving only one exposed varistor surface for conveniently attaching the electrodes. This limits the range of usable varistor configurations. Even more troublesome is the lack of reproducibility of varistor properties due to the inhomogenity of the zinc oxide grains in the pulverized varistor particles employed in the reconstituted device. The pulverized varistor particles are in effect small varistor devices, each made up of varying numbers of smaller ZnO grains separated at the boundaries by insulating materials. Since varistor material properties, such as breakdown voltage, are related to ZnO grain size, grain boundary, and thickness of the material between the electrodes, the presence of more ZnO grains (and hence grain boundaries) in one region of the varistor results in the occurrence of nonuniform properties in a single varistor. This lack of grain homogeneity may be, in part, attributable to the relatively low temperature (600° C.–1000° C.) at which the reconstituted varistor is sintered. The mixture is not heated to a sufficiently high temperature to homogenize ZnO grain distribution.

The present invention provides an economical method for fabricating free-standing, thick film varistors employing the screen printing process. The thick film varistors manufactured in accordance with this process are readily separable from the smooth insulating substrate on which they are fabricated, thus permitting electrodes to be easily attached to both sides of the varistor. Since unsintered varistor materials employed in the present invention comprise metal oxide particles as small as 10 millionths of an inch, the resulting varistors have good grain homogeneity and hence exhibit superiorly uniform electrical properties. In accordance with the method of the invention, free-standing, thick film varistors having a surface area in excess of 2×2 inches and a thickness of 5 thousandths of an inch have been produced.

SUMMARY OF THE INVENTION

Free-standing, thick film varistor slabs are fabricated by screen printing on a smooth aluminum oxide ($Al_2O_3$) substrate, a conventional unfired varistor mix combined with a suitable carrier. The printed varistor may be initially heated in air at a temperature of 100° C.-200° C. to evaporate the organic carrier, permitting additional thick films to be screen printed thereon as required. Thereafter, the varistor is fired in accordance with standard varistor fabricating techniques. For example, the varistor may be sintered in air at a temperature of 1000° C.-1400° C. for as long as 5 hours. The resulting thick film varistor adheres lightly to the insulating substrate and is easily separable therefrom. Any of the standard techniques may be employed to affix electrodes to the sintered, free-standing varistor. In the preferred method, silver electrodes are screen printed on the sintered, free-standing varistor and fired at temperatures between 500° C. and 850° C.

It is an object of the invention to produce a free-standing, thick film varistor having uniform electrical properties.

It is another object of the invention to fabricate a low voltage thick film varistor by screen printing unsintered varistor powders.

It is still another object of the invention to produce a free-standing, thick film varistor having a thickness of substantially less than 40 mils (1 millimeter).

BRIEF DESCRIPTION OF THE FIGURE

The novel features believed characteristic of the present invention are set forth in the appended claims. The invention itself, together with further objects and advantages thereof, may best be understood by reference to the following detailed description taken in connection with the appended drawing in which the single FIGURE is a voltage-current characteristic curve of a metal oxide varistor produced in accordance with the present invention.

DETAILED DESCRIPTION OF THE INVENTION

The free-standing, thick film varistors of the present invention are produced by screen printing on a high purity (e.g., approximately 99 percent) smooth aluminum oxide ($Al_2O_3$) substrate an unfired varistor powder. The varistor powder may conveniently comprise any of the standard compositions employed in fabricating metal oxide varistors by conventional methods. Typically, such varistor powders have zinc oxide (ZnO) as the primary constituent, and include smaller quantities of other metal oxide additives, such as bismuth oxide ($Bi_2O_3$), cobalt oxide ($Co_2O_3$), chromium oxide ($Cr_2O_3$) as well as other additives, which may include additional metal oxides. Examples of such additives include manganese oxide ($MnO_2$), antimony trioxide ($Sb_2O_3$), silicon dioxide ($SiO_2$), nickel oxide (NiO), magnesium oxide (MgO), aluminum nitrate ($Al(NO_3)_3.(H_2O)$), tin oxide ($SnO_2$), titanium oxide ($TiO_2$), nickel fluoride ($NiF_2$), barium carbonate ($BaCO_3$), and boric acid ($H_3BO_3$). The list of additives is not intended to be exhaustive, nor, generally, are all of the above-enumerated materials employed in a single varistor powder composition. By way of example, and not limitation, a varistor powder suitable for screen printing may comprise 0.5 mole percent $Bi_2O_3$, 0.5 mole percent $Co_2O_3$, 0.5 mole percent $MnO_2$, 1.0 mole percent $Sb_2O_3$, 0.5 mole percent $SnO_2$, 0.1 mole percent $BaCO_3$, 0.2 mole percent $H_3BO_3$, and the remainder being ZnO.

In order that the varistor powder may be easily handled during the screen printing process, it is mixed with a carrier material such as ethyl cellulose dissolved in pine oil to form an "ink" of suitable viscosity and consistency for conveniently "inking" a fine mesh screen which has formed thereon a pattern to be assumed by the printed varistor. Screen portions forming the varistor pattern are permeable and allow the varistor powder and carrier to be deposited on the aluminum oxide substrate. When the screen is removed, the varistor material remains on the substrate. The thickness of the printed varistor may be as low as ½ to 1 thousandth of an inch. If a varistor having greater thickness than ½ thousandth of an inch is desired, the printed varistor may be dried and additional varistor material screen printed thereover. The process may be repeated until varistor material is built up to the desired thickness. The drawing illustrates current-voltage properties for a varistor manufactured in accordance with the invention having a thickness of approximately 27 thousandths of an inch (0.059 millimeter).

Subsequent to the removal of the screen, the printed varistor may be heated in air at a temperature of approximately 100° C.-200° C. in order to evaporate the carrier material. The temperature at which this step is performed is not critical. The objective is to dry the printed varistor sufficiently to allow screen printing thereon of other thick films as required, including multiple varistor layers. The drying step may be eliminated if no further screen printing is required, and the printed varistor sintered in air at a temperature of 1000° C. to 1400° C. for approximately 5 minutes or for as long as 5 hours or longer. The sintered varistor material adheres lightly to the aluminum oxide substrate and is easily separable therefrom by, for instance, tapping gently on the substrate. The aluminum substrate which constitutes a major fraction of the varistor fabrication cost is thus saved and may be reused. Thick-film varistor slabs of 2×2 inches have been fabricated and with due care larger slabs may be produced.

Electrodes may be formed on the sintered varistor by any of the well-known techniques such as, for example, chemical vapor deposition, or plasma or flame-spraying. A technique which is particularly economical and easily automated involves screen printing the electrodes on a sintered thick-film varistor produced in accordance with the present invention. In order to bond the screen-printed electrodes to the varistor substrate, the varistor may be heated in air at a temperature of between approximately 500° C. and 850° C. for a time length of up to one hour. A suitable material for screen printing the electrodes may comprise powdered silver combined with a carrier material. An example of a material useful for screen printing electrodes is a silver-based thick-film composition manufactured by DuPont (Wilmington, Del.) and identified as No. 7713.

While ethyl cellulose dissolved in pine oil has been disclosed as a suitable carrier, other materials such as methyl methacrylate polymers dissolved in suitable organic solvents may also be used. Other materials which are inert and which form a liquid or paste of the desired consistency for application purposes are usable in practicing the invention.

The drawing illustrates the volt-ampere characteristic curve for a varistor material having a thickness of 0.059 mm and an electrode area of approximately 0.5 $mm^2$. It is to be noted that the varistor breakdown voltage is approximately 20 volts on the vertical axis. Currents through the varistor, corresponding to various applied voltages, are indicated on the horizontal axis.

From the foregoing, it may be appreciated that the present invention provides a free standing, thick film varistor fabricated by screen printing an unsintered varistor powder on an aluminum oxide substrate. Varistors fabricated in accordance with the invention reliably exhibit uniform electrical properties.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. A method of fabricating a free-standing, thick-film varistor comprising the steps of:

mixing unsintered metal oxide varistor powder with a carrier material to form a paste;

applying a substantially uniform thin film of said paste onto a surface of an aluminum oxide substrate;

sintering said thin paste film on said aluminum oxide substrate to form a varistor material; and separating said varistor material from said aluminum oxide substrate to form said free-standing, thick-film varistor.

2. The method of claim 1 wherein said varistor powder comprises ZnO as the primary constituent, $Bi_2O_3$, and at least one other material selected from the group consisting of $Co_2O_3$, $MnO_2$, $Sb_2O_3$, $BaCO_3$, and $H_3BO_3$.

3. The method of claim 1 or 2 wherein said step of sintering comprises the step of heating said thin paste film applied to said aluminum oxide substrate at a temperature of between about 1000° C. and about 1400° C. for a time of between about five minutes and five hours.

4. The method of claim 1 wherein said substrate comprises $Al_2O_3$ having a purity of approximately 99 percent.

5. The method of claim 1 wherein said varistor powder comprises 0.5 mole percent of each of $Bi_2O_3$, $Co_2O_3$, $MnO_2$, and $SnO_2$, 1 mole percent of $Sb_2O_3$, 0.1 mole percent of $BaCO_3$, 0.2 mole percent of $H_3BO_3$, and the remainder being ZnO.

6. The method of claim 1 or 2 wherein said varistor powder is mixed with sufficient quantities of a carrier material to form a material having a viscosity suitable for screen printing, and wherein said step of applying comprises the step of screen printing said unsintered varistor powder on a surface of said aluminum oxide substrate.

7. The method of claim 1 wherein at least one electrode is screen printed on said varistor subsequent to said sintering step.

8. A method of fabricating a free-standing, thick film varistor, comprising the steps of:

screen printing an unsintered metal oxide varistor powder on a smooth aluminum oxide substrate;

sintering said screen printed varistor powder in air at a temperature of between approximately 1000° C. and 1400° C. for a time of between approximately five minutes and 5 hours to form a varistor material; and separating said varistor material from said aluminum oxide substrate.

9. The method of claim 8 wherein said varistor powder comprises ZnO as the primary constituent, $Bi_2O_3$, and at least one other material selected from the group consisting of $Co_2O_3$, $MnO_2$, $Sb_2O_3$, $BaCO_3$, and $H_3BO_3$.

10. The method of claim 8 wherein said substrate comprises $Al_2O_3$ having a purity of approximately 99 percent.

11. The method of claim 8 wherein said varistor powder comprises 0.5 mole percent of each of $Bi_2O_3$, $C_2O_3$, $MnO_2$, and $SnO_2$, 1 mole percent of $Sb_2O_3$, 0.1 mole percent of $BaCO_3$, 0.2 mole percent of $H_3BO_3$, and the remainder being ZnO.

12. The method of claim 8 wherein said varistor powder is mixed with sufficient quantities of a carrier material to form a material having a viscosity suitable for screen printing.

13. The method of claim 12 wherein said carrier material comprises ethyl cellulose dissolved in pine oil.

14. The method of claim 12 wherein said screen printed varistor is heated at a temperature between approximately 100° C. and 200° C. for a sufficient length of time to evaporate said carrier material prior to said sintering step.

15. The method of claim 8 wherein at least one electrode is screen printed on said varistor subsequent to said sintering step.

16. The method of claim 15 wherein said sintered varistor is heated at a temperature of between about 500° C. and 850° C. for a time of up to one hour to thereby bond said electrode to said sintered varistor.

* * * * *